US009737124B2

(12) United States Patent
Xiao et al.

(10) Patent No.: US 9,737,124 B2
(45) Date of Patent: Aug. 22, 2017

(54) BAFFLE PLATE MECHANISM FOR A HAIR CURLER

(71) Applicant: SHENZHEN FENDA ELECTRICAL CO., LTD., Shenzhen (CN)

(72) Inventors: Yong Xiao, Shenzhen (CN); Mianjia Wei, Shenzhen (CN)

(73) Assignee: SHENZHEN FENDA ELECTRICAL CO., LTD., Shenzhen (CN)

( * ) Notice: Subject to any disclaimer, the term of this patent is extended or adjusted under 35 U.S.C. 154(b) by 204 days.

(21) Appl. No.: 14/754,725

(22) Filed: Jun. 30, 2015

(65) Prior Publication Data

US 2016/0073755 A1 Mar. 17, 2016

(30) Foreign Application Priority Data

Sep. 17, 2014 (CN) ..... 2014 2 0536599 U

(51) Int. Cl.

| | |
|---|---|
| ***A45D 6/02*** | (2006.01) |
| ***A45D 1/04*** | (2006.01) |
| ***A45D 2/00*** | (2006.01) |
| ***A45D 6/00*** | (2006.01) |

(52) U.S. Cl.

CPC ..... *A45D 1/04* (2013.01); *A45D 2/00* (2013.01); *A45D 6/00* (2013.01)

(58) Field of Classification Search

CPC ... A45D 1/00; A45D 1/04; A45D 1/10; A45D 1/16; A45D 1/28; A45D 2/00; A45D 2/02; A45D 2/10; A45D 2/36; A45D 2/367; A45D 6/00; A45D 6/02; A45D 6/20

See application file for complete search history.

(56) References Cited

U.S. PATENT DOCUMENTS

2014/0144459 A1* 5/2014 Fung ..... A45D 1/04 132/271

FOREIGN PATENT DOCUMENTS

CN 2679808 Y 2/2005

* cited by examiner

*Primary Examiner* — Rachel Steitz
(74) *Attorney, Agent, or Firm* — Gokalp Bayramoglu

(57) ABSTRACT

A baffle plate mechanism for a hair curler, mounted between a shell and a heating roller of the hair curler, comprises a button extending out of the shell; a push switch mounted in the shell and connected to the button; a telescope apparatus mounted in the shell; wherein the telescope apparatus includes a movable push rod and an electromagnet for driving the movable push rod to do a telescopic movement when electricity is applied; the movable push rod penetrates the electromagnet; the electromagnet is coupled electrically to the push switch; and a baffle plate coupled to an end of the movable push rod and opposite to the heating roller.

8 Claims, 8 Drawing Sheets

BAFFLE PLATE MECHANISM FOR A HAIR CURLER

TECHNICAL FIELD

The present invention relates to accessories of a hair curler, and specifically relates to a baffle plate mechanism for the hair curler.

BACKGROUND

A hair curler is a handle electronic production for curling hair. A conventional hair curler includes a handle and a heating roller. A heating portion of the heating roller is exposed outside, which may cause scald accident in use.

An end of a shell of the hair curler generally extends to form the handle. The shell is positioned surrounded outside the heating roller, and a guiding space for guiding hair is formed between the heating roller and the shell. The guiding space has advantages of rolling hair into the hair curler and preventing the rolling hair from going outside. However, the rolling hair in the guiding space may block the guiding space because of scattering hair or expanding hair, which may cause the hair curler to break down.

SUMMARY OF THE INVENTION

To overcome the defects described above, the present invention provides a baffle plate mechanism for a hair curler which can scrape off and press hair, and thus roll hair efficiently.

Some embodiments of the present invention refer to:

a baffle plate mechanism for a hair curler, mounted between a shell and a heating roller of the hair curler, comprises:

a button extending out of the shell;

a push switch mounted in the shell and connected to the button;

a telescope apparatus mounted in the shell; wherein the telescope apparatus includes a movable push rod and an electromagnet for driving the movable push rod to do a telescopic movement when electricity is applied; the movable push rod penetrates the electromagnet; and the electromagnet is coupled electrically to the push switch; and a baffle plate coupled to an end of the movable push rod and opposite to the heating roller.

Preferably, the baffle plate is a planar plate or a curved plate.

Preferably, the baffle plate mechanism further includes a retaining shell and a lever; the retaining shell has an accommodation space for housing the electromagnet; a middle portion of the lever is pivotally attachable to the shell; an end of the lever is pivotally attachable to the movable push rod; and the other end of the lever is pivotally attachable to the baffle plate.

Preferably, the retaining shell includes an upper cover and a lower cover attachable to the upper cover, a first pivot shaft is coupled between the upper cover and the lower cover; and the middle portion of the lever is pivotally attachable to the first pivot shaft.

Preferably, an end of the lever has an oval hole; a connecting pillar is perpendicularly attachable to the end of the movable push rod; and the connecting pillar is slidably positioned in the oval hole.

Preferably, a sliding track is mounted on the lower cover; the sliding track extends along the telescopic movement direction of the movable push rod; a sliding block is slidably mounted in the sliding track; the connecting pillar perpendicularly extends from a top portion of the sliding block; and the end of the movable push rod is fixedly mounted on the sliding block.

Preferably, a bottom of the lever has a curved convex bar; the lower cover has a curved groove; and the curved convex bar is slidably positioned in the curved groove.

Preferably, an end of the baffle plate has a pivot member pivotally attachable to the lever; the pivot member is adapted for limiting the swing angle of the baffle plate.

Preferably, the other end of the lever has a split groove; a connecting plate is mounted between both walls of the split groove and positioned in an inner portion of the split groove; a second pivot shaft is mounted between the both walls of the split groove and positioned in an outer portion of the split groove; the pivot member includes a pillar mounted in the baffle plate and two baffle walls extending from the pillar; the pillar has a pivot through-hole pivotally coupled with the second pivot shaft; an angle limiting space is formed between the two baffle walls; and a side end of the connecting plate extends into the angle limiting space.

Beneficial effects of the present invention are as follows:

The button is pressed to trigger the push switch to power on, and thus the electromagnet is powered on. The baffle plate is pushed to a preset position coupled with the heating roller by the movable push rod. The baffle plate is used for scraping off, pressing and limiting hair when the hair is being rolled, and preventing the hair from rolling 360 degrees.

DETAILED DESCRIPTION OF THE PREFERRED EMBODIMENTS

Figure 1:
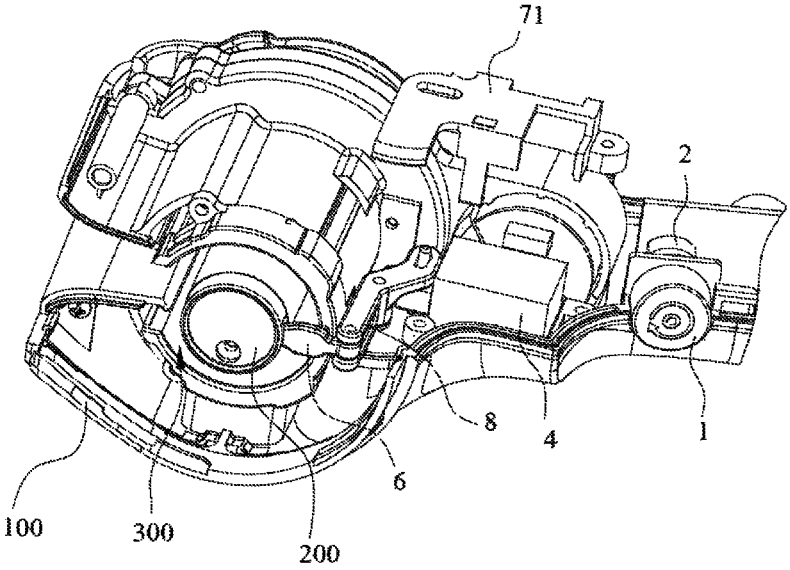
FIG. 1 is a schematic diagram of a baffle plate mechanism for a hair curler.
Figure 2:
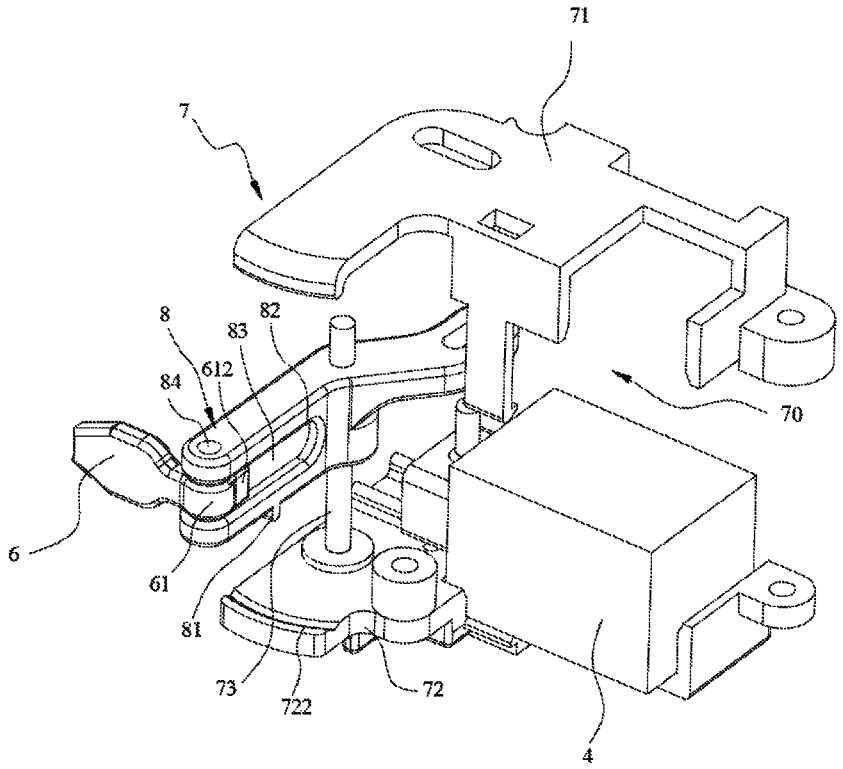
FIG. 2 is an exploded view of a baffle plate, an electromagnet, a lever, a movable push rod and a retain shell of the baffle plate in FIG. 1.
Figure 3:
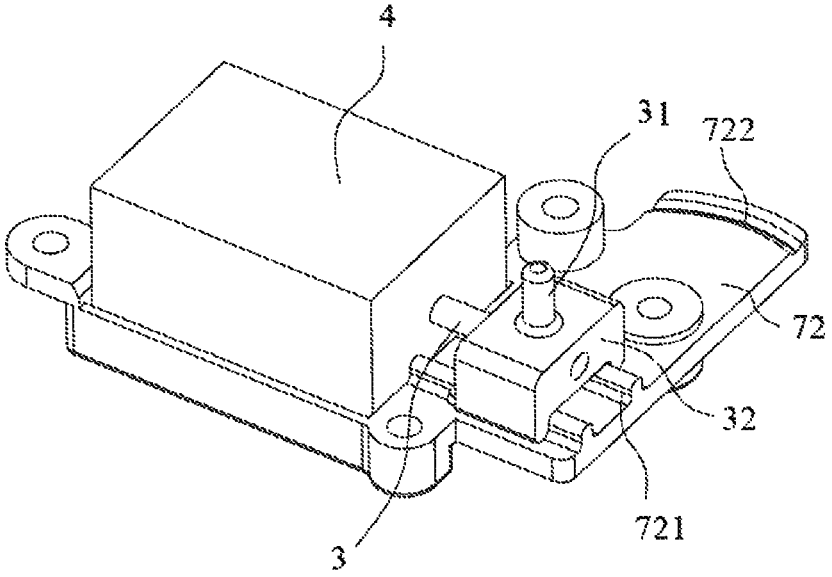
FIG. 3 is a schematic diagram of a sliding block and a sliding track of the baffle plate in FIG. 1.

Referring to the FIG. 1 to FIG. 3, a baffle plate mechanism for a hair curler is mounted between a shell 100 and a heating roller 200 of the hair curler. A guiding space 300 is formed between the shell 100 and the heating roller 200. The baffle plate mechanism includes a button 1 extending out of the shell 100, a push switch 2 mounted in the shell 100 and connected to the button 1 elastically, a telescope apparatus mounted in the shell 100. The telescope apparatus includes a movable push rod 3 and an electromagnet 4 for driving the movable push rod 3 to do a telescopic movement when electricity is applied. The movable push rod 3 penetrates the electromagnet. The electromagnet 4 is coupled electrically to the push switch 2. The baffle plate mechanism further includes a baffle plate 6 coupled to an end of the movable push rod 3 and opposite to the heating roller 200.

Referring to the FIG. 1 to FIG. 3, the button 1 is pressed to trigger the push switch 2 to power on, and thus the electromagnet 4 is powered on. The movable push rod 3 is pushed into the guiding space 300 by the electromagnet 4. The baffle plate 6 is pushed to a preset position coupled with the heating roller 200. The baffle plate 6 is used for scraping off, pressing and limiting hair when the hair is being rolled, and preventing the hair 5 from rolling 360 degrees. In this embodiment, the telescope apparatus may be configured with a conventional electromagnet to drive the movable push rod to move telescopically, or the telescope apparatus may be a one-way fast electromagnet push-rod device described in the Chinese invention patent (CN 200420006371.2), or the telescope apparatus may be configured with a motor to drive a gear, or configured with other electronic driving devices, or configured with a linear motor to drive the movable push rod 3.

Figure 6:
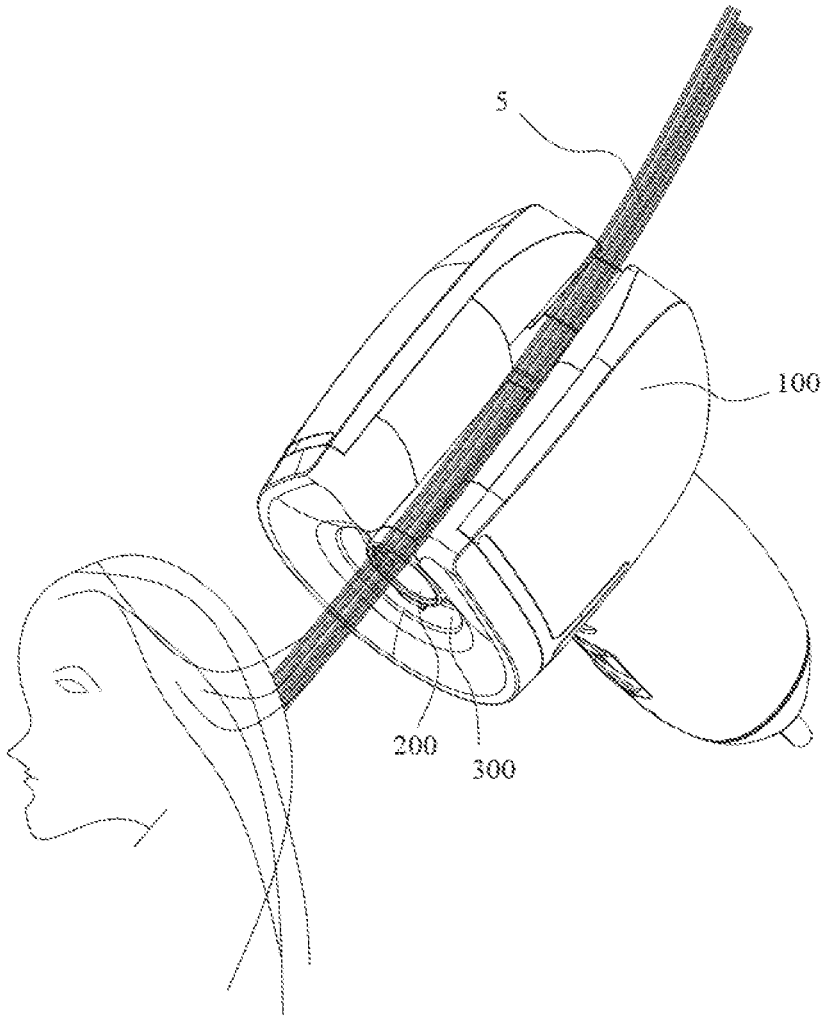
FIG. 6 shows that hair is putting into a guiding space of the hair curler in FIG. 1.
Figure 7:
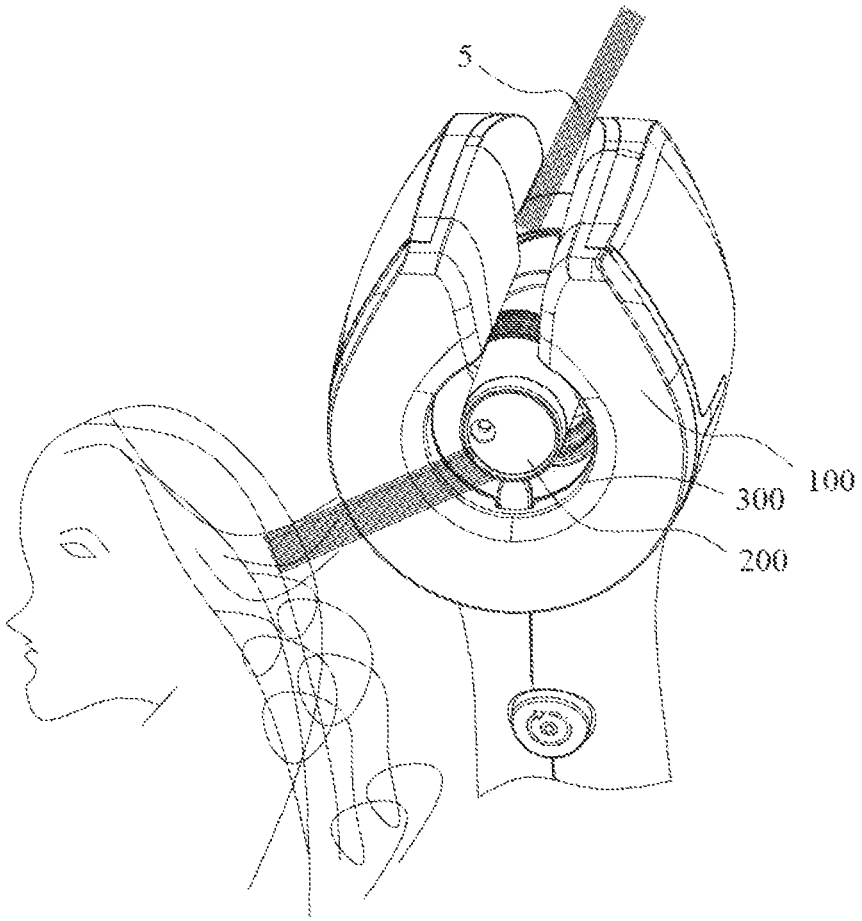
FIG. 7 shows that hair is rolled by a heating roller in FIG. 1.
Figure 8:
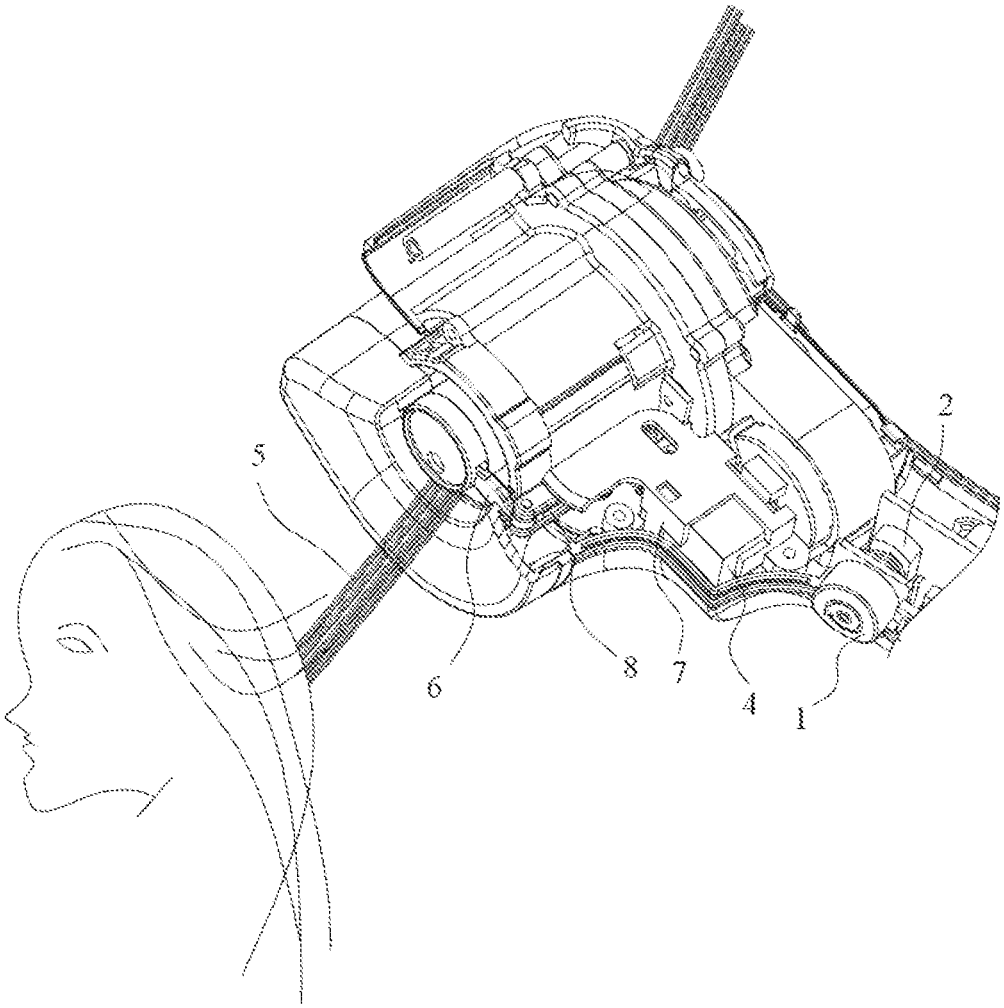
FIG. 8 shows that hair is rolled by the heating roller and limited by the baffle plate.

As shown in FIG. 6, the hair 5 is put in the guiding space 300, and rolled by the heating roller 200 (shown in FIG. 7). As shown in FIG. 8, the hair 5 is rolled by the heating roller 200 and limited by the baffle plate 6.

As shown in FIG. 1, when the button 1 is pressed again, the push switch 2 and the electromagnet 4 are powered off the movable push rod 3 is retracted and the baffle plate 6 moves back to an original position.

The baffle plate 6 can be preferably a planar plate or a curved plate. In other embodiments, the baffle plate 6 can be any shaped that can block hair.

As shown in FIG. 2, the baffle plate mechanism further includes a retaining shell 7 and a lever 8. The retaining shell 7 has an accommodation space 70 for housing the electromagnet 4, which plays a role in magnetic shielding. A middle portion of the lever 8 is pivotally attachable to the shell 100. An end of the lever 8 is pivotally attachable to the movable push rod 3. The other end of the lever 8 is pivotally attachable to the baffle plate 6. When the electromagnet 4 drives the movable push rod 3 to move telescopically, both ends of the lever 8 move oppositely, and the other end of the lever 8 drives the baffle plate 6 to move into or retract from the guiding space 300.

In this embodiment, referring to FIG. 2, the retaining shell 7 includes an upper cover 71 and a lower cover 72 attachable to the upper cover 71. A first pivot shaft 73 is coupled between the upper cover 71 and the lower cover 72. The middle portion of the lever 8 is pivotally attachable to the first pivot shaft 73. The lever 8 produces a leverage effect by pivotally connecting with the retaining shell 7 via the first pivot shaft 73.

Figure 4:
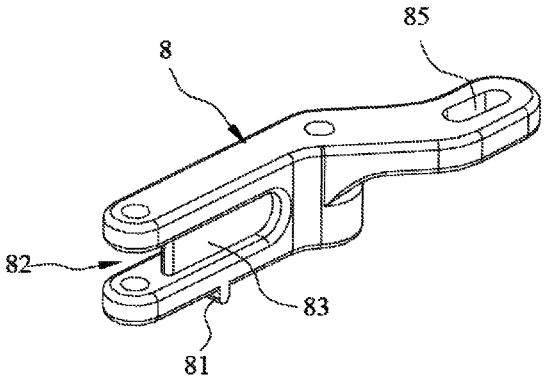
FIG. 4 is a schematic diagram of a lever of the baffle plate in FIG. 1.

In other embodiments, referring to FIG. 4, an end of the lever 8 has an oval hole 85. As shown in FIG. 3, a connecting pillar 31 is perpendicularly attachable to the end of the movable push rod 3. As shown in FIG. 1, the connecting pillar 31 is slidably positioned in the oval hole 85, which facilitates the telescopic movement of the movable push rod 3, and thus the lever 8 can easily play a leverage force on the baffle plate 6.

As shown in FIG. 3, a sliding track 721 is mounted on the lower cover 72, to help the lever 8 to turn more steadily. The sliding track 721 extends along the telescopic movement direction of the movable push rod 3. A sliding block 32 is slidably mounted in the sliding track 721. The connecting pillar 31 perpendicularly extends from a top portion of the sliding block 32. The end of the movable push rod 3 is fixedly mounted on the sliding block 32. The sliding track 721 and the sliding block 32 cooperatively facilitate the movable push rod 3 to generate a telescopic force on the lever 8 steadily.

As shown in FIG. 2 and FIG. 4, a bottom of the lever 8 has a curved convex bar 81. The lower cover 72 has a curved groove 722. The curved convex bar 81 is slidably positioned in the curved groove 722. The curved convex bar 81 and the curved groove 722 cooperatively facilitate the lever 8 and the baffle plate 6 to move more steadily.

Figure 5:
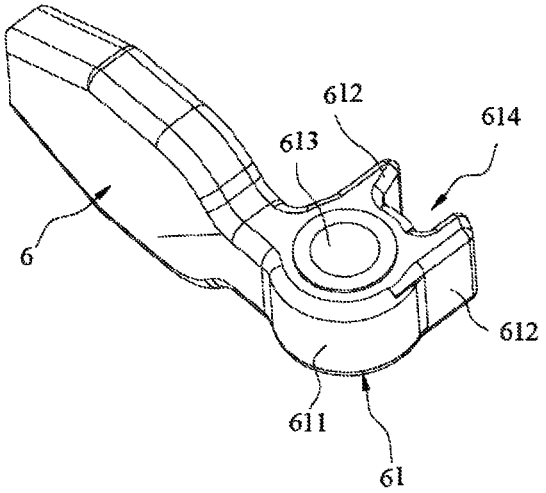
FIG. 5 is a schematic diagram of a baffle plate of the baffle plate in FIG. 1.

As shown in FIG. 5, an end of the baffle plate 6 has a pivot member 61 pivotally attachable to the lever 8. The pivot member 61 is adapted for limiting the swing angle of the baffle plate 6, so that the baffle plate makes a limited swing based on the amount of hair 5.

In this embodiment, referring to FIG. 4 and FIG. 5, the other end of the lever 8 has a split groove 82. A connecting plate 83 is mounted between both walls of the split groove 82 and positioned in an inner portion of the split groove 82. A second pivot shaft 84 is mounted between the both walls of the split groove 82 and positioned in an outer portion of the split groove 82. The pivot member 61 includes a pillar 611 mounted in the baffle plate 6 and two baffle walls 612 extending from the pillar 611. The pillar 611 has a pivot through-hole 613 pivotally coupled with the second pivot shaft 84. An angle limiting space 614 is formed between the two baffle walls 612. A side end of the connecting plate 83 extends into the angle limiting space 614, so that the baffle plate 6 is limited by the two baffle walls 612.

Various modifications could be made to the embodiments by those of ordinary skill in the art without departing from the true spirit and scope of the disclosure. And those modified embodiments are covered by the claims of the disclosure.

What is claimed is:

1. A baffle plate mechanism for a hair curler, mounted between a shell and a heating roller of the hair curler, comprising:

a button extending out of the shell;

a push switch mounted in the shell and connected to the button;

a telescope apparatus mounted in the shell; wherein the telescope apparatus includes a movable push rod and an electromagnet for driving the movable push rod to do a telescopic movement when electricity is applied; the movable push rod penetrates the electromagnet; and the electromagnet is coupled electrically to the push switch; and a baffle plate coupled to an end of the movable push rod and opposite to the heating roller, wherein the baffle plate mechanism further includes a retaining shell and a lever; the retaining shell has an accommodation space for housing the electromagnet; a middle portion of the lever is pivotally attachable to the shell; an end of the lever is pivotally attachable to the movable push rod; and the other end of the lever is pivotally attachable to the baffle plate.

2. The baffle plate mechanism of claim 1, wherein herein the retaining shell includes an upper cover and a lower cover attachable to the upper cover; a first pivot shaft is coupled between the upper cover and the lower cover; and the middle portion of the lever is pivotally attachable to the first pivot shaft.

3. The baffle plate mechanism of claim 1, wherein an end of the lever has an oval hole; a connecting pillar is perpendicularly attachable to the end of the movable push rod; and the connecting pillar is slidably positioned in the oval hole.

4. The baffle plate mechanism of claim 3, wherein a sliding track is mounted on the lower cover; the sliding track extends along the telescopic movement direction of the movable push rod; a sliding block is slidably mounted in the sliding track; the connecting pillar perpendicularly extends from a top portion of the sliding block; and the end of the movable push rod is fixedly mounted on the sliding block.

5. The baffle plate mechanism of claim 4, wherein a bottom of the lever has a curved convex bar the lower cover has a curved groove; and the curved convex bar is slidably positioned in the curved groove.

6. The baffle plate mechanism of claim 5, wherein an end of the baffle plate has a pivot member pivotally attachable to the lever; the pivot member is adapted for limiting the swing angle of the baffle plate.

7. The baffle plate mechanism of claim 6, wherein the other end of the lever has a split groove; a connecting plate is mounted between both walls of the split groove and positioned in an inner portion of the split groove; a second pivot shaft is mounted between the both walls of the split groove and positioned in an outer portion of the split groove; the pivot member includes a pillar mounted in the baffle plate and two baffle walls extending from the pillar; the pillar has a pivot through-hole pivotally coupled with the second pivot shaft; an angle limiting space is formed between the two baffle walls; and a side end of the connecting plate extends into the angle limiting space.

8. The baffle plate mechanism of claim 1, wherein the baffle plate is a planar plate or a curved plate.

* * * * *